United States Patent [19]

Rickerl

[11] Patent Number: 4,920,769

[45] Date of Patent: May 1, 1990

[54] WARP KNITTED V-SHAPED BRIEFS

[75] Inventor: Peter Rickerl, Wiehl, Fed. Rep. of Germany

[73] Assignee: Müller Textil GmbH, Wiehl, Fed. Rep. of Germany

[21] Appl. No.: 157,733

[22] Filed: Feb. 18, 1988

[30] Foreign Application Priority Data

Feb. 18, 1987 [DE] Fed. Rep. of Germany ..... 3705137

[51] Int. Cl.[5] ..... A41B 9/06

[52] U.S. Cl. ..... 66/176; 66/177; 66/195; 66/196; 2/400; 2/402; 2/403; 2/406

[58] Field of Search ..... 2/400, 402, 403, 406; 66/177, 176, 87, 170, 178, 195, 196

[56] References Cited

FOREIGN PATENT DOCUMENTS 1059576 2/1967 United Kingdom ..... 66/178

1072715 6/1967 United Kingdom ..... 66/178

*Primary Examiner*—H. Hampton Hunter

*Attorney, Agent, or Firm*—Toren, McGeady & Associates

[57] ABSTRACT

The invention relates to V-shaped briefs which can be produced in one piece and which consist of a preferably elastic crotch or gusset part and two side bands of essentially uniform width made of a decorative knitted border. The briefs are produced by continuously knitting single or double layer material widths which after having separated only need to be worked on along one seam or not at all in order to obtain the finished briefs. In addition, it is possible to sew on stocking parts with a very steep leg line. Production is considerably simplified and costs greatly reduced without adversely affecting the wearing properties and the fashionable appearance of the garment.

3 Claims, 5 Drawing Sheets

WARP KNITTED V-SHAPED BRIEFS

BACKGROUND OF THE INVENTION

The invention relates to warp knitted briefs or a warp knitted part of a pair of tights appearing V-shaped in use and consisting of a crotch or gusset part which, in one piece, covers the entire intimate or crotch area, and two side bands of essentially uniform width whose respective ends adjoin the crotch or gusset part.

Briefs of this kind are known as fashionable products which in use have a very high leg line and a waistband which is cut out at the front and back. For decorative purposes, the side bands are designed in the form of laced edging, whereas for hygienic reasons the crotch part is made of an absorbant material. When used as part of a pair of tights, such products are attached by sewing to the usual leg parts with or without pattern and with an extremely steep leg line.

It is a known fact in the textile industry that wages have a considerable influence on the production costs. In consequence, with the above-mentioned garments, too, sewing the side parts to the crotch part represents a considerable cost factor which adversely affects the price of the product.

SUMMARY OF THE INVENTION

It is therefore the object of the invention to reduce the production costs of briefs of the above-mentioned type without being detrimental to comfort and the fashionable aspect, by providing new products and processes.

The objective is achieved by providing a warp knitted pair of briefs or a warp knitted part of a pair of tights of the initially described type in the case of which a crotch or gusset part and the side bands, in at least one of their respective connecting regions, are knitted together or into each other to form one piece. By providing this kind of design which can be achieved by different production processes, at least one of the sewing processes required for connecting the side bands to the crotch part is eliminated so that at least 50% of the wages for manual finishing incurred if the briefs are manufactured in accordance with the state of the art are saved.

According to a first embodiment of the invention already indicated, the crotch or gusset part and the two side bands are knitted together to form one piece at the front or back end of the briefs, whereas at the respective other end they are sewn together. The transition from the crotch part to the side bands may be designed in several ways to take account of the aspects of fashion. In a particularly advantageous embodiment, the two side bands, just before their free ends, pass into a joint band of double width thereby requiring only one single continuous sewing operation for completing the briefs in accordance with the invention.

According to a second possible embodiment of a pair of briefs in accordance with the invention, the crotch part and the two side bands are knitted together at the front and back to form one single piece so that the side bands no longer have any free ends and there is no longer any need for any sewing operations, which means that production costs are again reduced to a considerable extent. In this case, too, the material of the side bands, before passing into the crotch part, may pass into a joint strip, which, after a short length, is followed by the differently structural material of the crotch part. In this way it is possible to achieve an uninterrupted transition line.

The length of the combined region of the side bands at the front end of the briefs is usually greater than at the back end.

A process in accordance with the invention for producing warp knitted briefs of the intially described type is characterised in that in a continuous single layer operation, one crotch or gusset part and two parallel, entirely or predominantly separated side bands alternate in being periodically knitted together transversely to the direction of knitting. This process produces widths of intermediate products which in subsequent operations are separated transversely to the direction of knitting and sewn along one single line to form a closed loop which due to the space between the two side bands in which the opening for the body can be seen, forms a finished product. As already mentioned above, it is advantageous not to transversely separate the two free ends of the side bands until after they have been combined to a closed band because then, instead of having two independent short seams, one longer joint seam between the crotch part and the side bands is capable of completing the product.

A suitable process for producing briefs of the second type preferred to above is characterised in that, in a continuous double layer operation, one crotch or gusset part and two parallel, entirely or predominantly separated side bands are periodically knitted into each other one above the other transversely to the direction of knitting. In this way it is possible to produce widths of intermediate products which need to be transversely separated exclusively in the regions knitted into each other in order to obtain a completely finished product which no longer requires any sewing or seaming operations. In this case, too, the space between the two side bands forms the opening for the body, whereas the separated edges which are positioned at the outer end in the direction of knitting and which, via the connecting regions knitted into each other, become closed loops representing the leg openings.

Irrespective of which of the above-described processes is used to produce the warp knitted briefs in accordance with the invention, it is possible to sew stockings with a steep leg line on to the leg opening so that a finished pair of tights with a body portion according to the invention is obtained. It is appreciated that after such a sewing opertion and also in the case of the individual briefs, it is necessary to turn the product after having separated it from the material run in order to ensure that the separated regions are inside.

When changing the position of the space between the side bands relative to the separating regions it is possible, in deviating from the above-described production processes, to manufacture briefs in the case of which the separated regions or seams are positioned in the region of the side bands, especially on the hips and possibly in the centre of the crotch. It is advantageous to produce briefs by the above process in those cases where different structures and/or different materials are to be used for the front and back parts of the briefs.

In preferred embodiments of the products in accordance with the invention and manufacturing processes adapted to them, the crotch or gusset part consists of cotton threads with a percentage of elastic material, whereas the lace-like side bands consist of a synthetic material comprising a percentage of elastic material or having elastic properties, especially consisting of polyamide with lycra threads. To improve adaptation to the anatomy of the body it is advantageous for the crotch or gusset part, in the intimate region, to comprise a longitudinal portion with an increased stitch density, whereas in the region intended for the back part the crotch or gusset part is knitted with increasingly looser stitches, especially as compared to the region intended for the front part. Whereas as a rule, the transition from the crotch part to the side bands extends perpendicularly relative to the longitudinal extension of the bands, aspects of fashion may dictate that with reference to the crotch part on the front of the briefs the transition should be arrow-shaped so as to be V-shaped, an arrangement which will result in a slightly deviating shape.

Preferred embodiments of the invention and intermediate products manufactured by processes in accordance with the invention are illustrated in the drawings and described hereafter.

BRIEF DESCRIPTION OF THE DRAWING

FIG. 1 shows a front view of briefs 1 in accordance with the invention, which consist of a crotch or gusset part 2 and two side bands 3*a*, 3*b* which are attached to it and run into a double width material portion 4 and adjoin the crotch part in a connection region 5. As roughly indicated, the side bands 3*a*,3*b* and the connecting portion 4 serve decorative purposes.

FIG. 2 again illustrates the briefs 1 in accordance with the invention, consisting of the crotch part 2 and the side bands 3*a*, 3*b* which in this case remain essentially separated and abut in a straight line in a connecting region 6 between the crotch part 2 and the side bands 3 so that a continuous seam or separating region is produced between the side bands 3*a*, 3*b* and the crotch part 2. FIG. 3*a* shows a front view of a pair of briefs in accordance with the invention on the left, and FIG. 3*b* shows a rear view on the right. Whereas the front view essentially corresponds to the illustration of the briefs given in FIGS. 1 and 2, the back view deviates in that to match the connected region of the side bands on the front part, there has been provided a connected region 7 of the side bands on the front part, which passes into the crotch part 2 in an essentially straight connecting region 6.

FIG. 4*a* shows a front view of a pair of briefs in accordance with the invention on the left, and FIG. 4b a back view on the right. On the front, the side bands 3 join the crotch part 2 individually and independently of each other, with the crotch part 2 comprising an arrow- or V-shaped connected region 8. In accordance with the design of the briefs illustrated in FIGS. 1 and 2, the back part of this embodiment comprises side bands 3*a*, 3*b* which are largely separated from each other and do not have a pronounced joint region.

FIG. 5 shows a single layer material width which is composed of portions 9 for the crotch parts and portions 10 for the side bands periodically following each other. The portions 9 comprise an asymmetrically arranged narrow area 11 which is produced with a narrower stitch width to be able to adapt to the anatomy of the body in the crotch region. The portions 10 having decorative patterns comprise a longitudinally asymmetrical separating slot 12 which results in the creation of the two side bands 3*a*, 3*b* and their joint portion 4 of double width. In the areas pointed at by arrows, the material portions cnsisting of a portion 9 and a second portion 10 may be separated so that the separated semiportions 13 may subsequently be sewn together to form the finished briefs.

FIG. 6 shows a single layer material width which essentially corresponds to that of FIG. 5. However, the narrow areas in the longitudinal portions 9 for the crotch parts are not shown, but in deviating from FIG. 5, the portions 9 comprise V-shaped connected regions 8 which are adjoined directly by the slots 12 of the portions 10 forming the side bands 3*a*, 3*b*. This means that the side bands form a separate transition area 14*a*, 14*b* which, however, is knitted continuously since the separating areas 13, which are again marked by arrows, are provided in a different area in this embodiment. The region of the V-shaped transitions 8 represents the front part of the briefs in accordance with the invention, which, after separating the regions pointed at by arrows and sewing together the separated semiportions 13, is completed at the back.

FIG. 7 shows a double layer material whose upper layer is identical to the portions 10 as illustrated in FIG. 5, and which, in particular, comprises asymmetrical slots 12 which extend longitudinally relative to the separating portions 13 and through which the side bands 3*a*, 3*b* and the transition areas 4 are formed, whereas the lower layer shown in a dashed line is identical to the portion 9 of the embodiment shown in FIG. 5, the advantage of this method of production being that the two layers may be made of different materials to suit the respective application and that after separating of the connecting and separating portions 13 completely finished briefs are available which require no further treatment.

FIG. 8 shows a double layer material in the cases of which the upper layer essentially corresponds to the portions 10 as illustrated in FIG. 6 and which, in particular, comprises a slot 12 reaching as far as the V-shaped transition area 8, whereas the lower layer essentially corresponds to the portions 9 of the material to FIG. 6, an essential difference being, however, that the V-shaped area 8 is separated from the remaining crotch part 9 by half a separating area 13 which forms a seam and in this embodiment therefore consists of a different material. As a result, the overall length of the bands is shortened relative to the crotch part. The V-shaped region could also be positioned in the lower layer so that the length of the bands would be increased relative to the crotch part. This would result in seams in the bands. After separating the individual material portions one obtains finished briefs which essentially correspond to the briefs as illustrated in FIG. 4.

LIST OF REFERENCE NUMBERS

Figure 1:
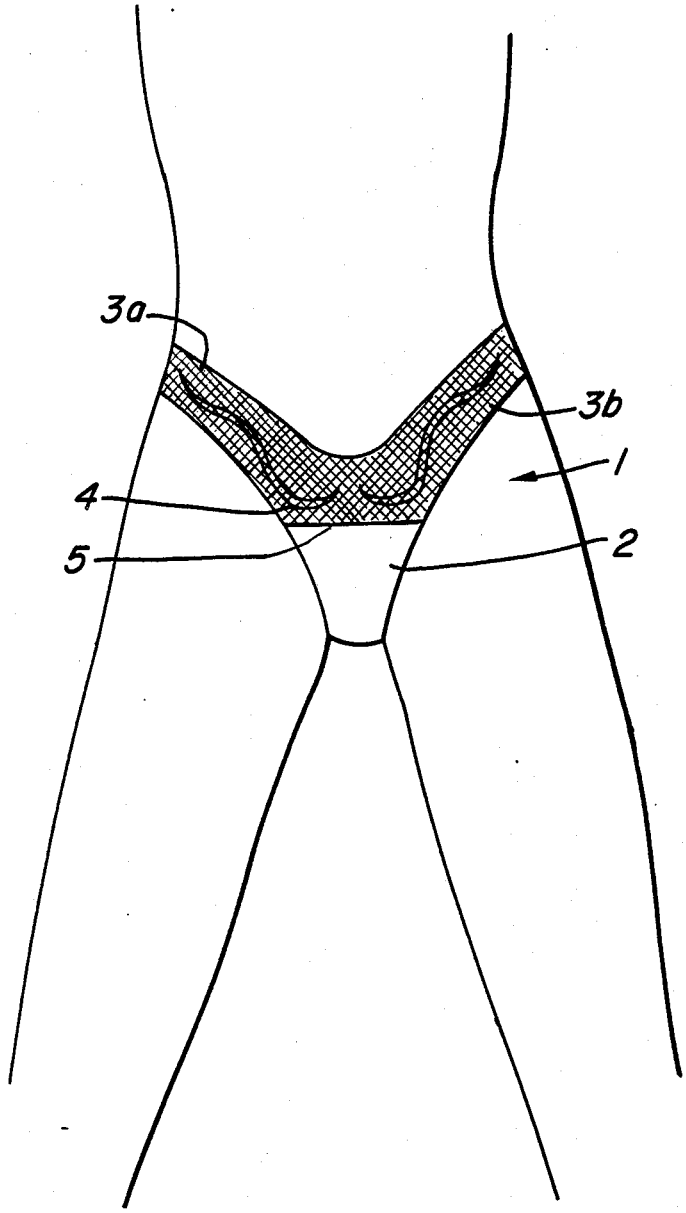
FIG. 1 shows a front view of a pair of briefs in accordance with the invention worn by a torso not forming part of the invention
Figure 2:
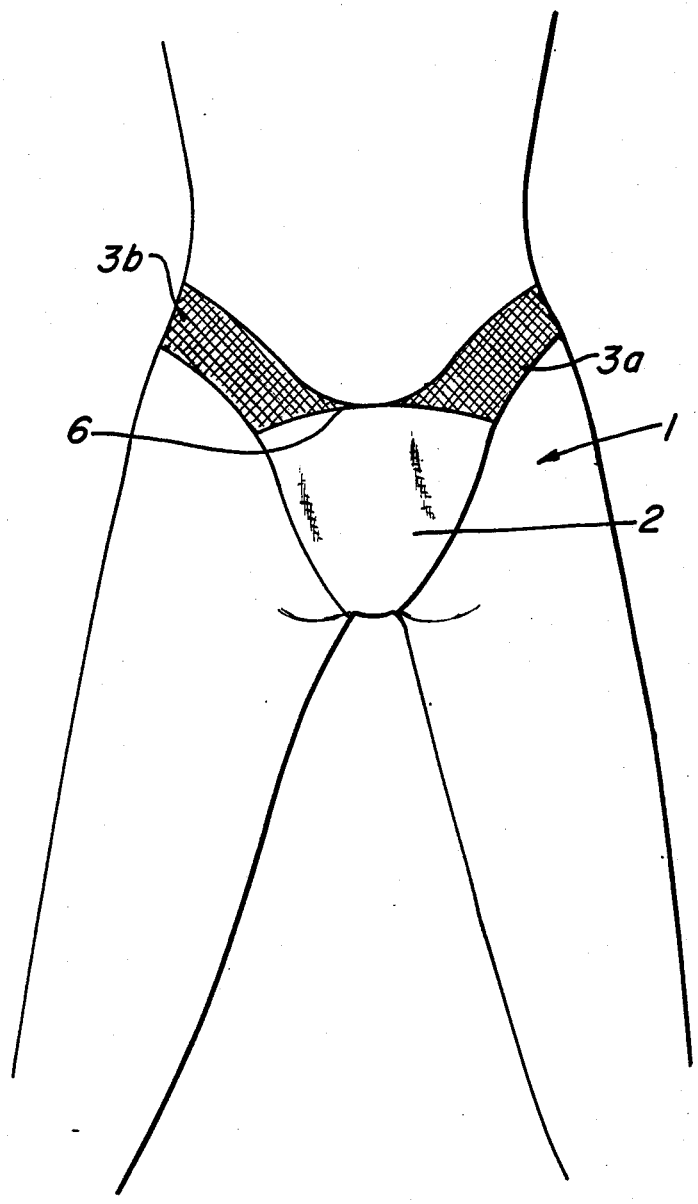
FIG. 2 shows a back view of a pair of briefs in accordance with the invention worn by a torso not forming part of the invention
Figure 3A:
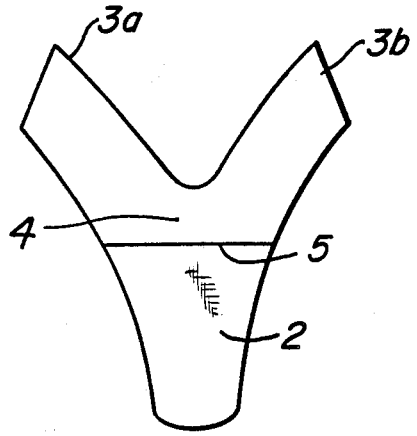
FIGS. 3*a* and 3*b* shows a front and back view of a first modified embodiment of a pair of briefs in accordance with the invention.
Figure 3B:
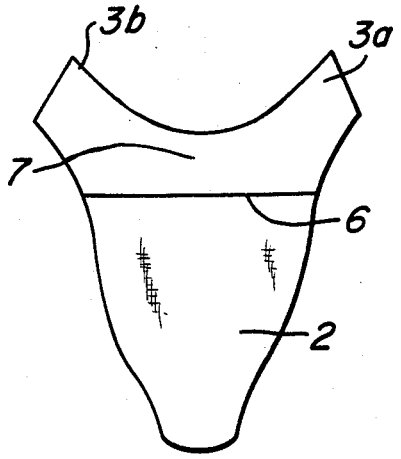
Figure 4A:
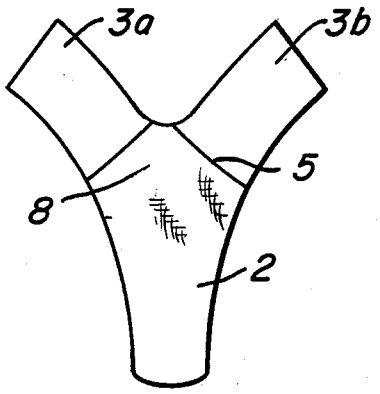
FIGS. 4*a* and 4*b* shows a front and back view of a second modified embodiment of a pair of briefs in accordance with the invention.
Figure 4B:
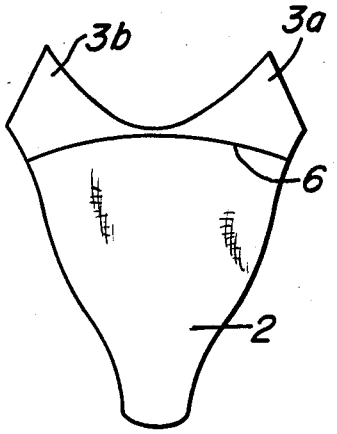
Figure 5:
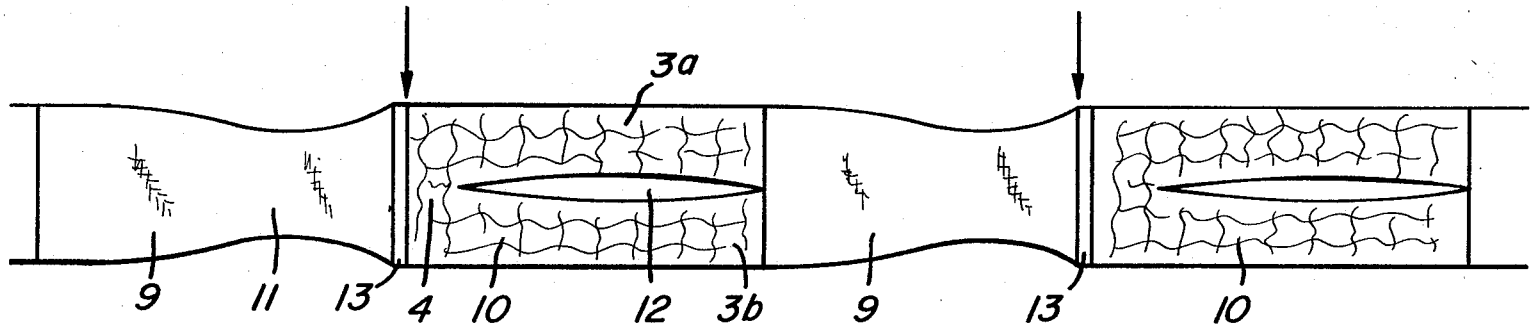
FIG. 5 shows a first embodiment of a single layer material width produced by the process in accordance with the invention.
Figure 6:
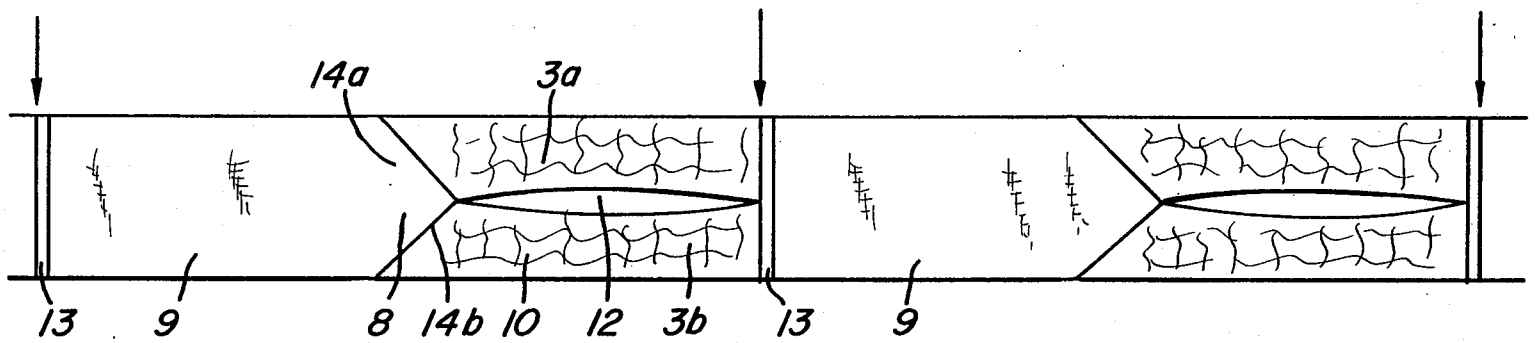
FIG. 6 shows a second embodiment of a single layer material width produced by the process in accordance with the invention.
Figure 7:
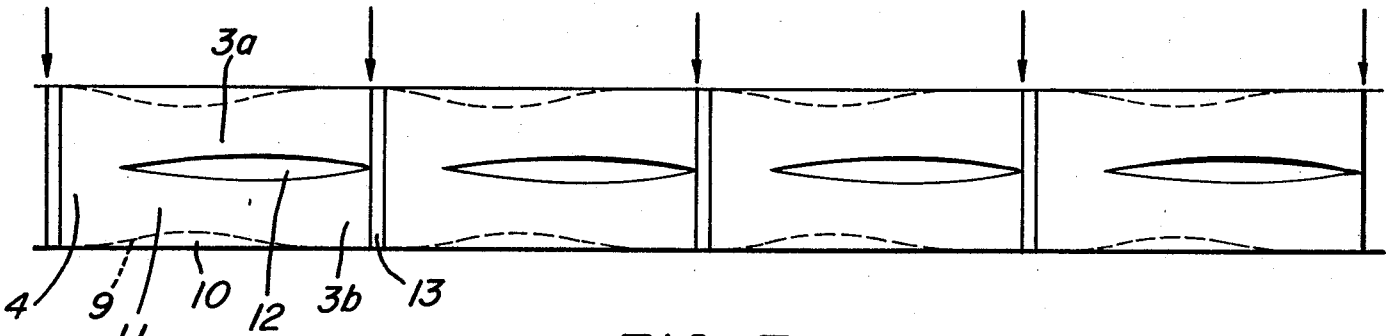
FIG. 7 shows a first embodiment of a double layer material width produced by the process in accordance with the invention.
Figure 8:
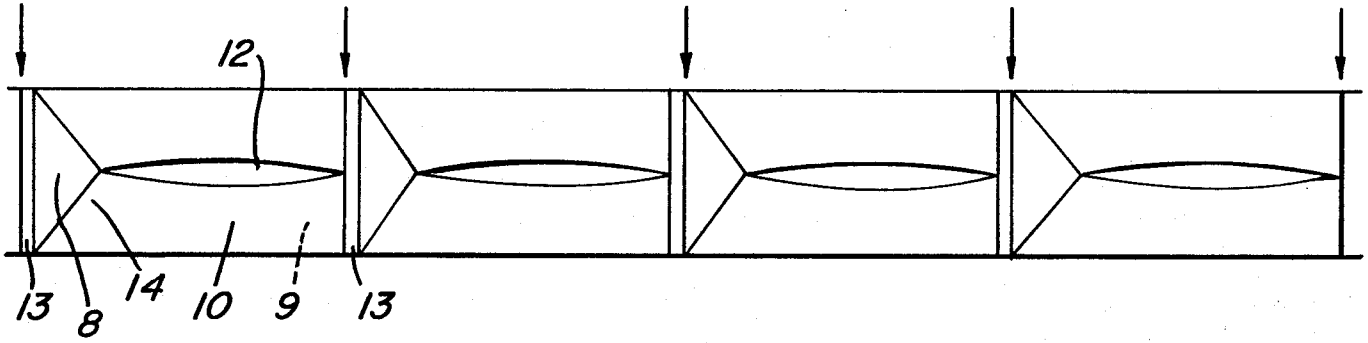
FIG. 8 shows a second embodiment of a double layer material width produced by the process in accordance with the invention.

1: briefs
2: crotch part
3: side band
4: band region (double)
5: connecting region
6: connecting region
7: band region (double)
8: connecting part (V-shaped)
9: crotch material
10: sid band material
11: narrow area
12: longitudinal slot
13: separating area
14: transition area.

I claim:

1. A process of producing warp knitted briefs or a warp knitted part of a pair of tights where the knitted brief or knitted part includes a crotch part and side bands connected to the crotch part, comprising the steps of knitting continuously in a knitting direction a double layer of material formed of repeating first layer units having a first end and a second end extending transversely of the knitting direction superimposed on repeating second layer units having a direction superimposed on repeating second layer units having a first end and a second end extending transversely of the knitting direction and being separate from the first layer units, knitting one of the first layer units and second layer units as a crotch portion with a center line extending in the knitting direction and knitting the other one of the first and second layer units as a pair of side bands extending in the knitting direction and being separated from one another and forming a waist opening, at least partially in the knitting direction, knitting the first ends of said first and second layer units together and knitting the second ends of said first and second layer units together along a line extending transversely of the knitting direction, and cutting the double layer material along the first and second ends so that each first and second layer units knitted together at the first and second ends thereof form one of a knitted brief or a knitted part of a pair of tights.

2. A process, as set forth in claim 20, including the step of knitting a slot extending in the knitting direction between said side bands with said slot extending from one of said first and second ends and terminating spaced from the other one of said first and second ends and said slot operating to separate said side bands.

3. A process, as set forth in claim including 1 the steps of knitting the crotch in one of said first and second layer units with a V-shaped portion of the crotch extending into the other one of said first and second layers, and knitting a slot separating said side bands from one of said first and second ends to the V-shaped portion of the crotch.

* * * * *

UNITED STATES PATENT AND TRADEMARK OFFICE

CERTIFICATE OF CORRECTION

PATENT NO. : 4,920,769

DATED : May 1, 1990

INVENTOR(S) : Peter Rickerl

It is certified that error appears in the above-identified patent and that said Letters Patent is hereby corrected as shown below:

Column 6, line 18, claim 2, line 1, change "20" to -- 1 --.

Signed and Sealed this

Twenty-eighth Day of January, 1992

*Attest:*

HARRY F. MANBECK, JR.

*Attesting Officer*

*Commissioner of Patents and Trademarks*